US010720726B2

(12) United States Patent
Patwardhan

(10) Patent No.: US 10,720,726 B2
(45) Date of Patent: Jul. 21, 2020

(54) ZERO INSERTION FORCE POWER CONNECTOR

(71) Applicant: Satyajit Patwardhan, Fremont, CA (US)

(72) Inventor: Satyajit Patwardhan, Fremont, CA (US)

( * ) Notice: Subject to any disclaimer, the term of this patent is extended or adjusted under 35 U.S.C. 154(b) by 0 days.

(21) Appl. No.: 15/844,555

(22) Filed: Dec. 17, 2017

(65) Prior Publication Data

US 2019/0190182 A1 Jun. 20, 2019

(51) Int. Cl.
*H01R 13/193* (2006.01)

(52) U.S. Cl.
CPC ..... *H01R 13/193* (2013.01)

(58) Field of Classification Search
CPC ..... H01R 13/193; H01R 13/18; H01R 13/187
USPC ..... 439/263, 265, 268, 378
See application file for complete search history.

(56) References Cited

U.S. PATENT DOCUMENTS 3,950,059 A * 4/1976 Anhalt ..... H01R 13/193 439/261
4,744,768 A * 5/1988 Rios ..... H05K 7/1007 439/262
4,997,385 A * 3/1991 Casagrande ..... H01R 13/193 439/259
5,073,124 A * 12/1991 Powell ..... H01R 13/035 200/83 B
5,162,004 A * 11/1992 Kuzuno ..... H01R 13/193 439/845
7,316,579 B2 * 1/2008 Roath ..... G01R 1/0466 439/260

* cited by examiner

*Primary Examiner* — Vanessa Girardi

(57) ABSTRACT

A zero-insertion force socket connector that mates with a standard pin connector with zero insertion force. An actuation mechanism built into the socket connector, actuated after mating creates a level of contact force necessary to establish good electrical contact. The socket actuation is designed such that the socket contact does not exert any compression force on its mating pin contact during mating. This helps eliminate potential buckling of slender contact pins when large contact force is required. The socket design works with a standard pin contact such as the one, on every electric vehicle. Thus, the invention allows connecting to an existing electric vehicle without any modification, with zero insertion force, yet delivers the necessary contact force and preserves the long-term integrity of the connector pins by eliminating potential pin buckling during mating.

1 Claim, 6 Drawing Sheets

Detail-B

ZERO INSERTION FORCE POWER CONNECTOR

FIELD OF THE INVENTION AND PRIOR ART RELATED TO THE INVENTION

Field of the Invention

The field of invention is zero-insertion-force electrical connectors. These connectors allow mating between two connector halves with negligible force.

Description of Related Art

Traditionally, zero insertion force contacts are used for inserting microchips with delicate pins into an electrical circuit. The power level involved in this type of connection is very low. The typical requirement here is the ease of insertion without deforming the pins and then subsequently making sure each individual pin is securely connected to its mating contact. There are several designs proposed to address this field of technology. However, at the other end of the power spectrum i.e. for very high power connectors, there are no zero insertion force designs proposed. This is mainly because thus far the high power connections were typically not detachable connections. However, with the advent of modern EVs this is changing. An EV charging connector is by definition a detachable connector that has to carry 50, 100 or 400 amperes. It also needs to be operable by all types of drivers, including a frail individual and yet guarantee a high quality electrical connection. One additional requirement—mostly driven by the way the EV market has evolved, is that any charging connector is required to work with standard charging port on EVs without any modification.

BRIEF SUMMARY OF THE INVENTION

This invention teaches a connector, which is capable mating with zero insertion force with a standard pin, is able to create a very high contact force, does not create any pushback or recoil to the person or robot handling the connector and in the process, completely eliminates the compressive force exerted on the pin—which is typical for a traditional pin-and-socket joint; thus, eliminating the bending or buckling of slender connector pins.

DETAILED DESCRIPTION OF THE INVENTION

An electrical power connector has two halves, each carrying a group of connectors. These connector halves are brought together to mate with each other in a particular relative orientation. Frequently, the connectors have mechanical guides on one or both halves to guide the mating process into correct orientation such that each of the contacts from the first half mates with its matching counterpart from the second half. Furthermore, if the contact pairs are pin-and-socket type, then an insertion force is required while mating the connector halves. This insertion force is required to push the pins into its mating socket against the opposing friction force created by the socket's grip on the pin. The sliding of pin with respect to socket in the presence of a strong contact force is an important requirement for establishing good quality contact. As a side effect, this insertion force acts to create compressive stress in the pin and if the pin-and-socket is misaligned, or if the required insertion force is large, the pin may experience buckling or similar distortion. This invention teaches a contactor that needs zero insertion force, but when a mechanism on the connector is actuated, it creates large contact forces and orchestrates sliding of pin with respect to socket while maintaining the contact force. Furthermore, the clever design of the actuation mechanism eliminates compressive stress on the pin and converts it to tensile stress, thus eliminating the possibility of buckling distortion even when the friction and contact forces between pin and socket are high.

Figure 1:
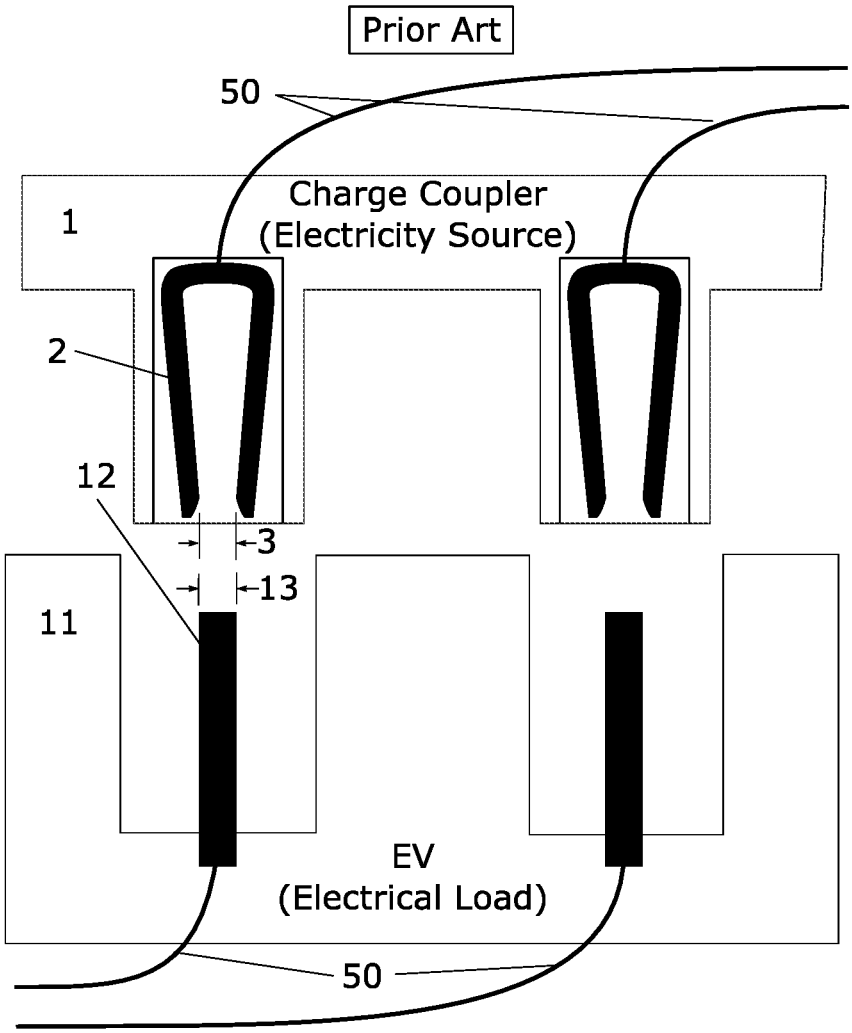
FIG. 1: A connector with pin and socket contacts that is typical in prior art. Shown here in disengaged position.
Figure 2:
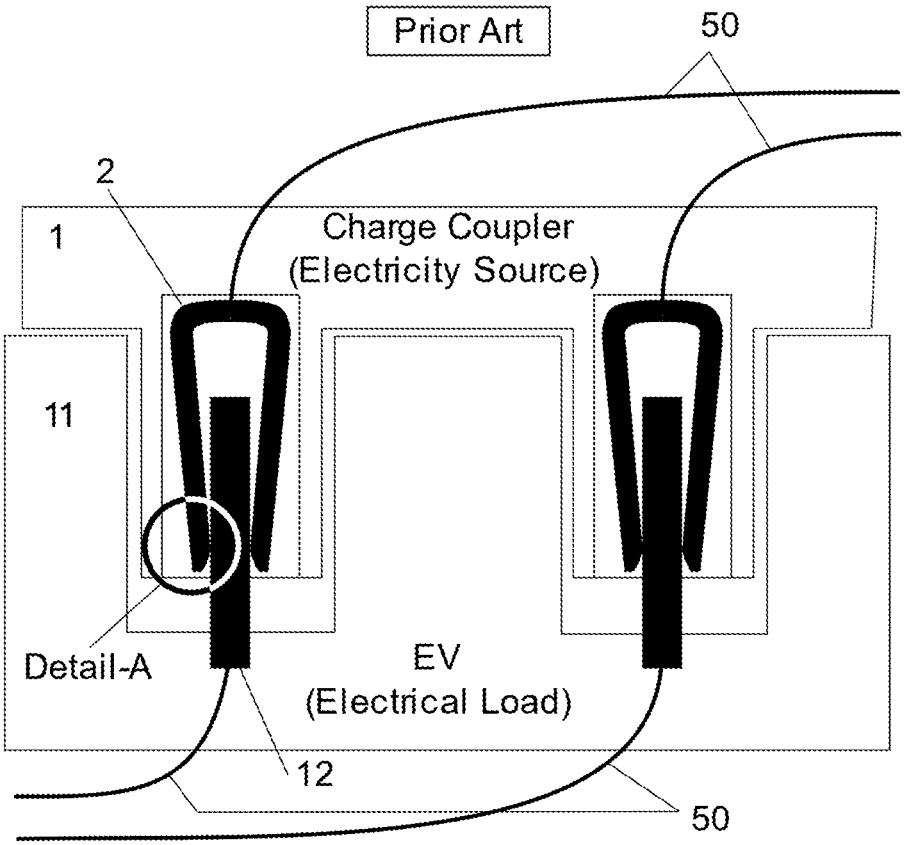
FIG. 2: A connector with pin and socket contacts that is typical in prior art. Shown here in engaged position. The forces encountered by the pin and the socket during engagement process are also shown in detail.
Figure 3:
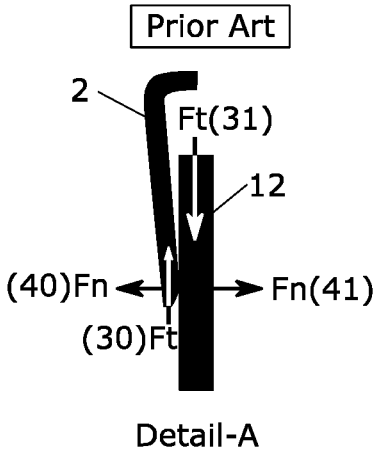
FIG. 3 Detail view of pin and socket contacts showing forces acting on the pin and the socket.

The Arrangement:

A basic design of a traditional pin and socket connector commonly found in prior art is shown in FIG. 1 and FIG. 2. The FIG. 1 shows two connector halves 1 and 11 of connector in disconnected position and FIG. 2 shows the two connector halves of the connector in their mated position. The important parts of the connector assembly are: Socket-side connector half 1, Pin-side connector half 11, the socket contact 2 and the pin contact 12. The wires 50 connect the source and drain of the electricity to socket 2 and pin 12 of the connector. From the safety viewpoint, the socket is typically connected to the source of the electricity and pin to the drain of electricity. FIG. 3 also shows the force marked 30 of magnitude Ft and acting on socket, force marked 40 of magnitude Fn and acting on socket, force marked 31 of magnitude Ft and acting on the pin, force marked 41 of magnitude Fn and acting on pin. As seen in FIG. 1, the dimension of socket opening (3) is slightly smaller than dimension (13) of the pin. This makes the socket to expand slightly during engagement and create force Fn. Also due to friction across socket-pin interface, force Ft is generated, which resists the insertion of pin into the socket. This force Ft is the insertion force. It should be noted that when Fn increases, Ft also increases. The quality of electrical connection improves i.e. the contact resistance decreases when Fn increases. Hence it is desirable to increase Fn, but as a result, insertion force Ft also increases. It is easy to see that in the traditional pin-and-socket connector of FIG. 1, FIG. 2 and FIG. 3, Ft's action on the pin (12) is in the direction of compressing the pin 12.

Figure 4:
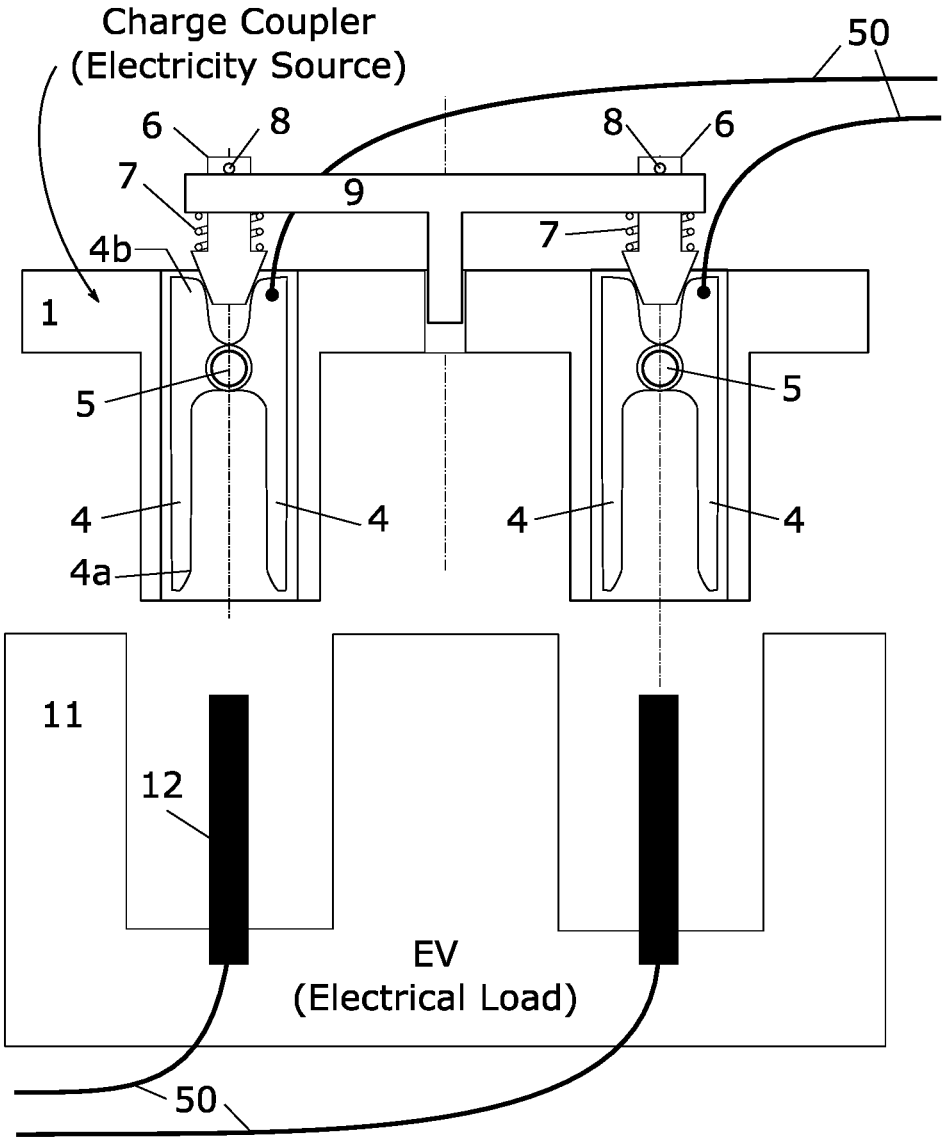
FIG. 4 Construction details of one embodiment of this invention showing the modified socket-side connector that can mate with unmodified pin-side connector.

FIG. 4 shows one embodiment of the invention. This invention teaches a modified socket-side connector half as shown in FIG. 4. The pin-side connector half is intentionally left unchanged, so that the invention can be applied to mate with corresponding, unmodified pin connector. The socket side connector half starts with connector half 1. The socket is split into a plurality of socket-pieces 4 that are attached to connector half 1 through the hinge 5. A spring-loaded-plunger 6 is carried by a push plate 9 and is in turn composed of a spring 7 which is kept in compression using the pin 8. Electrical wires 50 are connected to the split socket-pieces 4.

Figure 5:
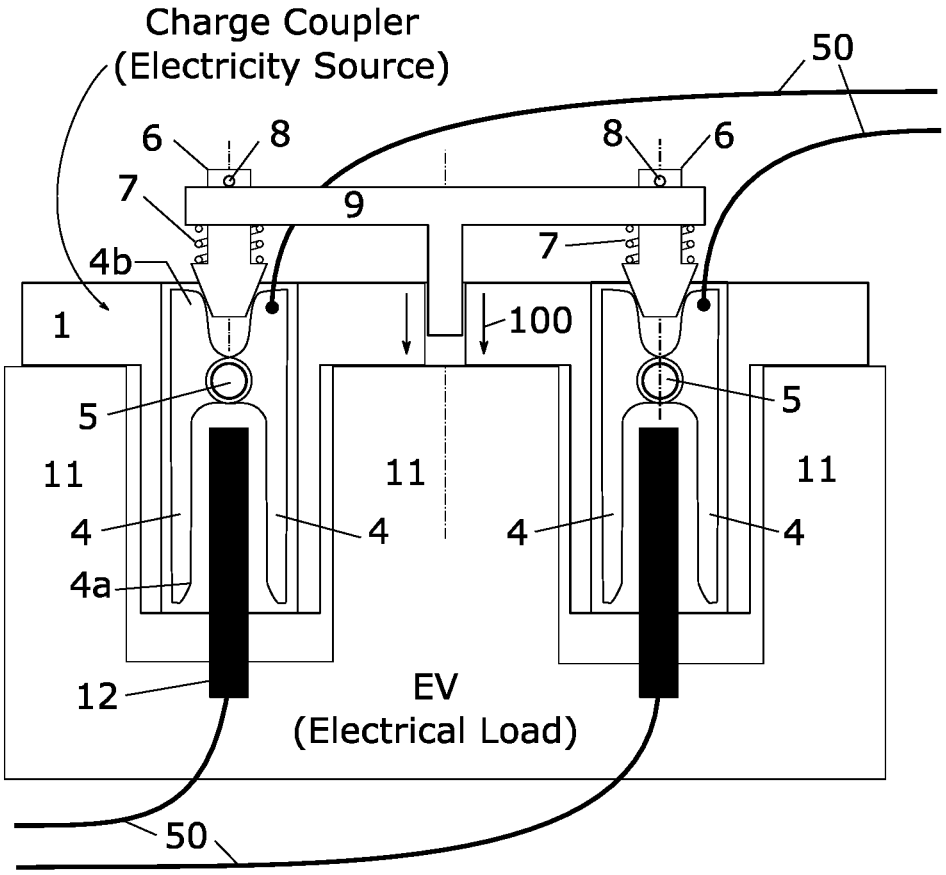
FIG. 5 Step 1 of engagement process of the two connector halves.
Figure 6:
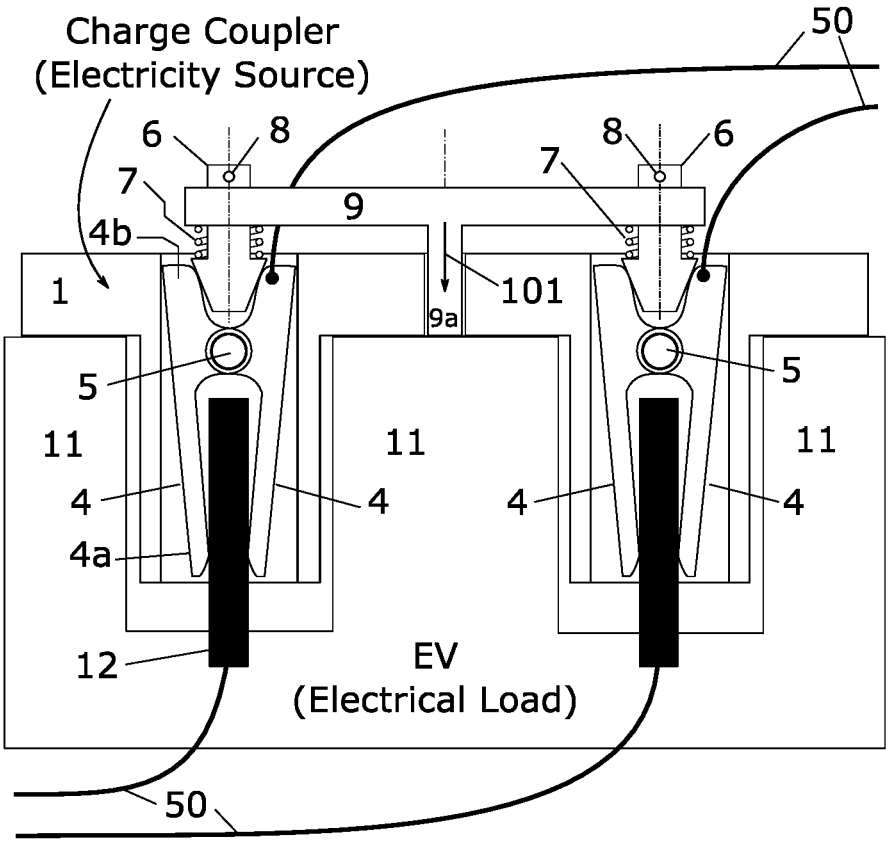
FIG. 6 Step 2 of engagement process of the two connector halves.
Figure 7:
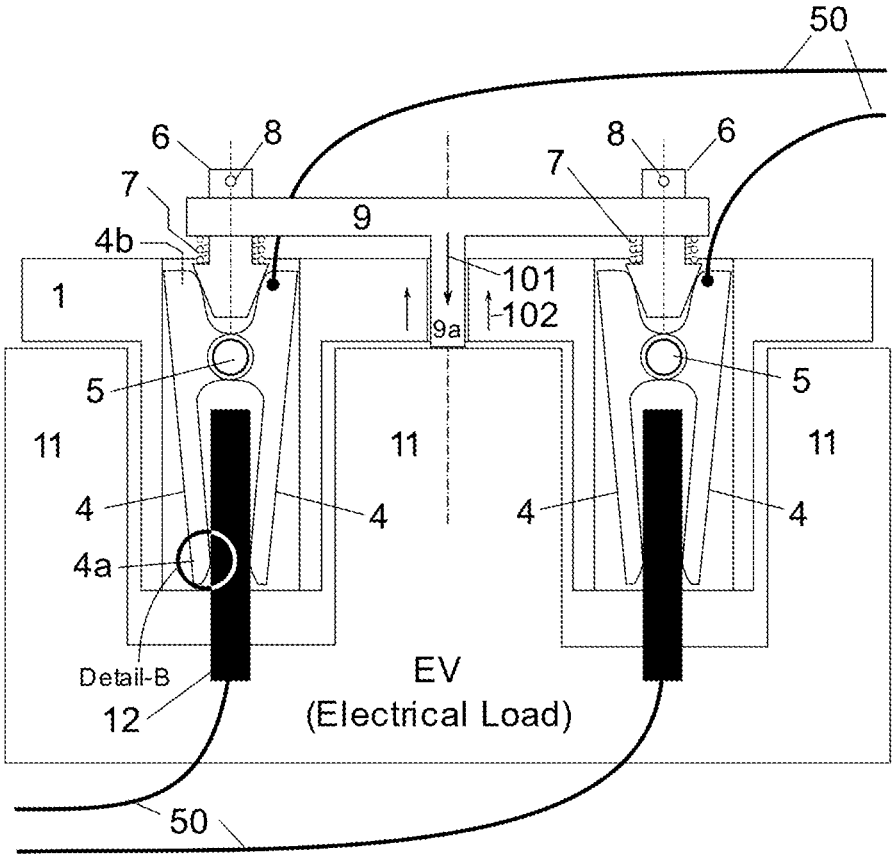
FIG. 7 Step 3 of engagement process of the two connector halves.
Figure 8:
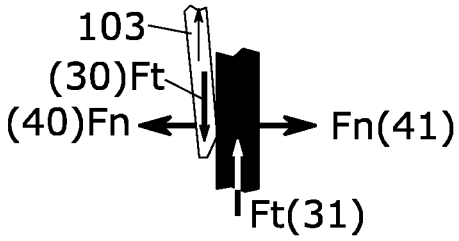
FIG. 8 Detail view of zero insertion force connector showing forces acting on the pin and the split socket.

Operation:

FIG. 4 to FIG. 7 show the operating sequence for one embodiment of the invention. FIG. 4 shows the two connector halves in disengaged state. FIG. 5 shows the first step of engagement where the socket-side connector half 1 is moved (see motion arrows 100), to mate with pin-side half. In this motion, the connector half 1, the push plate 9, the spring-loaded-plunger 6; all move together as one piece. FIG. 6 shows the next step where the push plate 9 is moved with respect to connector half 1 (see motion arrows 101) until the protrusion 9*a* of the push plate 9 reaches the pin side connector half 11. By this action the plunger 6 is also pushed into one end of the socket-pieces 4, thus forcing their other end to clamp around the pin 12. Notice that a predetermined force produced by the spring 7 pushes the spring-loaded-plunger 6 into socket-pieces 4 and in turn the socket-pieces 4 exert a predetermined clamping or contact force on pin 12. FIG. 7 shows the next step when the push plate 9 is moved further with respect to the socket-side half 1 (see motion arrows 101). As the protrusion 9*a* pushes on pin-side half 11, it causes the socket-side half 1 to move away from pin-side half 11 (see motion arrows 102). In the process the socket-pieces 4 that are already exerting contact force on the pins; slide with respect to the pin. Note that the sliding is such that the pins are in tension as opposed to compression as is the case of traditional pin and socket connection. FIG. 8 also shows the force marked 30 of magnitude Ft and acting on socket, force marked 40 of magnitude Fn and acting on socket, force marked 31 of magnitude Ft and acting on the pin, force marked 41 of magnitude Fn and acting on pin. As described earlier, the force Fn is a direct result of the force exerted by the spring-loaded-plunger 6 on socket-pieces 4, which in turn is a direct result of force created by spring 7. Also, the direction for force marked 31 is such that it puts the pin in tension, thus eliminating any buckling distortion. In a traditional pin and socket connection shown in FIG. 1, when the socket wears out, the dimension 3 increases and the socket no longer has to expand as much as when the contacts were new. As a result, the contact force Fn starts to diminish and consequently the contact resistance starts to creep up. However, the invention described in FIG. 7 continues to create consistent contact force Fn even in the presence of contact wear because contact force Fn is controlled by spring 7, which compensates for the wear.

Advantages:

(i) Zero Insertion Force: during the act of mating (see FIG. 5, motion 100), the force required to move socket-side connector half is negligible since the socket-pieces 4 are wide open and allow free relative motion between pin and socket, (ii) Lighter Robot Design: if the two connector halves are brought together by a robot, the elimination of insertion force allows a lighter robot design. Furthermore, when the connector is actuated, the generated force is between two internal components (1 and 9 of FIG. 6 and FIG. 7) of socket half of the connector and subsequently between the socket-side half and pin-side half of the connector (FIG. 7). This actuation force never gets transmitted back to the robot arm orchestrating the mating. (iii) Consistent Contact Force: Since the contact force Fn (see FIG. 7) is controlled by an independent spring 7, a consistent contact force is generated even after contact wear. (iv) No Buckling: The sliding between the pin and the socket happens in the direction of pull (see FIG. 7, motion 103) and thus eliminates the possibility of any buckling of pins.

APPLICATION

One of the important application of this technology is in the field of robotic hands-free charging of electric vehicles (EVs). In this application, a robot end effector would be fitted with one half of an EV charging connector (typically the socket-side half), and the other half would be installed on the electric vehicle. When the EV is to be charged, the robot would move its end effector and the attached connector half to mate with the connector half mounted on the EV. If this connector is to be designed as described in this invention, the Robot design can be light. Or phrased differently, the same robot can extend itself to its most overstretched configuration and yet be able to perform the insertion task since the insertion forces are zero. Furthermore, the connectors will deliver consistent and high contact forces that won't degrade over time and eliminate pin deformation. Due to zero insertion force and extra opening offered by the socket contacts as well elimination of pin deformation tendencies, the robot arm may have slightly extra leeway in alignment.

What is claimed is:

1. An electrical connector with a first, pin-side, half and a second, socket-side, half, configured to mate with each other, further comprising, a) first group of "n" pin type contacts attached to the first half of the connector, b) a second group of "n" socket type contacts, each of which is made of "m" socket-pieces that are hinged to the second half of the connector, such that when the first and the second connector halves mate, each of the pin type contacts is surrounded by the "m" socket-pieces of each of the socket type contacts without any mating force between each of the pin type contact and the socket pieces, c) a push plate that can translate with respect to the second connector half, having a protrusion, d) one or more spring-loaded-plungers, carried by the push plate such that after the first and the second connector halves mate and when the push plate is moved towards the first connector half until the protrusion meets the first contact half, each of the spring-loaded-plungers exerts force on the socket-pieces, which in turn exert clamping force around the pin-type contacts; whereas upon further motion of the push plate, the protrusion pushes the first contact half away from the second contact half, and in turn creates pull motion between the socket-pieces and the pin-type-contacts.

* * * * *